United States Patent [19]

Leifeld

[11] Patent Number: 4,779,310

[45] Date of Patent: Oct. 25, 1988

[54] APPARATUS FOR EVENING A CARD-PRODUCED SLIVER

[75] Inventor: Ferdinand Leifeld, Kempen, Fed. Rep. of Germany

[73] Assignee: Trützschler GmbH & Co. KG, Mönchengladbach, Fed. Rep. of Germany

[21] Appl. No.: 52,593

[22] Filed: May 21, 1987

[30] Foreign Application Priority Data

May 24, 1986 [DE] Fed. Rep. of Germany ..... 3617525

[51] Int. Cl.[4] ..... D01G 15/36

[52] U.S. Cl. ..... 19/105; 19/106 R; 19/240

[58] Field of Search ..... 19/105, 106 R, 240

[56] References Cited

U.S. PATENT DOCUMENTS 4,438,548 3/1984 Grunder ..... 19/105
4,530,134 7/1985 Hosel ..... 19/106 R

FOREIGN PATENT DOCUMENTS 2704241 1/1980 Fed. Rep. of Germany .
3120133 12/1982 Fed. Rep. of Germany .
3218114 12/1982 Fed. Rep. of Germany .
3229402 2/1984 Fed. Rep. of Germany .
3507242 11/1985 Fed. Rep. of Germany .
0466105 1/1969 Switzerland .
0522051 6/1972 Switzerland .
0659087 12/1986 Switzerland .

OTHER PUBLICATIONS

Von Herbert Becker, Bericht über den 8. Internationalen Kongress mit Ausstellung für Mess-und Automatisierungstechnik, Teil 2, Interkama 80, VDI-Z 123(1981) Nr. ½, Jan.

*Primary Examiner*—Louis K. Rimrodt
*Attorney, Agent, or Firm*—Spencer & Frank

[57] ABSTRACT

An apparatus in combination with a carding machine and a regulatable tuft feeding device for evening a running sliver produced by the carding machine. The assembly has a fiber-handling roller forming part of the carding machine, a motor drivingly connected to the roller, an rpm-setting device connected to the motor, a desired value setter connected with the regulatable tuft feeding device; a measuring device for determining momentary values of mass of the running sliver; a regulator connected to the measuring device and to the rpm-setting device for controlling the rpm of the roller as a function of the sliver mass sensed by the measuring device. There is further provided a limit value indicating device connected to the rpm-setting device for responding to predetermined setting limits.

9 Claims, 3 Drawing Sheets

APPARATUS FOR EVENING A CARD-PRODUCED SLIVER

BACKGROUND OF THE INVENTION

This invention relates to an apparatus for evening a card-produced sliver or a fiber lap. The carding machine is associated with a settable fiber tuft feeding arrangement including a desired value setter. The carding machine is further associated with a measuring member such as a sliver trumpet which senses the sliver mass and which is connected by means of a regulator with an rpm setting device serving a drive motor of a roller such as the feed roller or doffer of the carding machine.

In a known apparatus, with the feed roller and the doffer there is associated an electronic motor rpm regulator which may be, for example, a "SIMOREG" model, manufactured by Siemens AG, Federal Republic of Germany. As long as the motor regulation is effected within predetermined limits, a regulation of the feed roller or the doffer is desired. In case the motor regulation operates outside determined limits, the draft or output rate is altered in an undesired manner because of an over-regulation of the feed roller or the doffer. This occurrence disadvantageously affects the uniformity of the sliver or the fiber lap.

SUMMARY OF THE INVENTION

It is an object of the invention to provide an improved apparatus of the above-outlined type from which the discussed disadvantages are eliminated and which, in particular, permits the production of a uniform card sliver or fiber lap.

This object and others to become apparent as the specification progresses, are accomplished by the invention, according to which, briefly stated, with the rpm setting device there is associated a limit value indicating device for predetermined setting limits.

By virtue of the limit value indicating device it is possible to detect an undesired change of the draft or the output rate when the regulator operates outside predetermined regulating ranges. In this manner it is achieved that the processing of the fiber material can be regulated in a desired manner so that a uniform card sliver, card web or fiber lap is obtained.

According to an advantageous feature of the invention, the limit value indicating device is connected with the desired value setter of the fiber tuft feeding arrangement. In this manner, a correction by varying the quantities of the supplied fibers is possible such that the regulator will once again operate in the predetermined, desired regulating range. According to a further feature of the invention, the limit value indicating device is a voltage comparator.

According to a preferred embodiment of the invention, the tuft feeding arrangement is a vertical feed chute-type tuft feeder, wherein the wall of the feed chute, for example, in the zone of air outlet openings which are provided in the feed chute and through which air exits from the feed chute to be recirculated thereinto, is settable in its depth to thereby vary the quantity of the throughgoing fiber tufts.

According to another preferred embodiment of the invention, the tuft feeding arrangement is constituted by the regulated feed roller of the card. By altering the speed of the feed roller, the quantities of the fiber tufts supplied to the card are varied.

According to a further advantageous feature of the invention, the measuring member for the sliver mass, the rpm setting device and the desired value setter of the tuft feeding arrangement are connected with a computer which measures and compares the predetermined setting values for the rpm setting device and in case of an excess value, applies a signal to the desired value setter of the tuft feeding arrangement.

The regulating device is switched on during operation. After a short period of observation the computer requests information as to the predetermined regulating bandwidth range in which the card operates. If such operation takes place at the upper or lower limit, the computer calculates the draft variation which is necessary to shift the regulating system to operate in the mid zone of the regulating range. After such computation the draft is changed upon command by the computer, based on the computation. In case the doffer is regulated, the desired discharge speed is simultaneously monitored to determine whether it is within the permitted limits. Permitted speed variations lead to draft changes by changing the doffer rpm. If a change in excess of the permitted limits is computed, then similarly to an excess, values for the alteration of the feed roller rpm are computed and the change is automatically effected. If after proceeding in such a manner there still remain unpermitted reference values, the computer will calculate, for example, the extent to which the chute wall of the tuft feeder should be shifted. This occurrence is automatically effected under computer control. Upon expiration of the lost period (card feeder-filling/lap feed/card), monitoring is again effected and the above-described procedure may be repeated for fine setting. The desired draft values, the relationships between the lap weight on the feed side and the position of the feed chute wall as well as all other required structural relationships are applied to the memory of the computer either based on data tables or as empirically determined curves.

DESCRIPTION OF THE PREFERRED EMBODIMENTS

Figure 1:
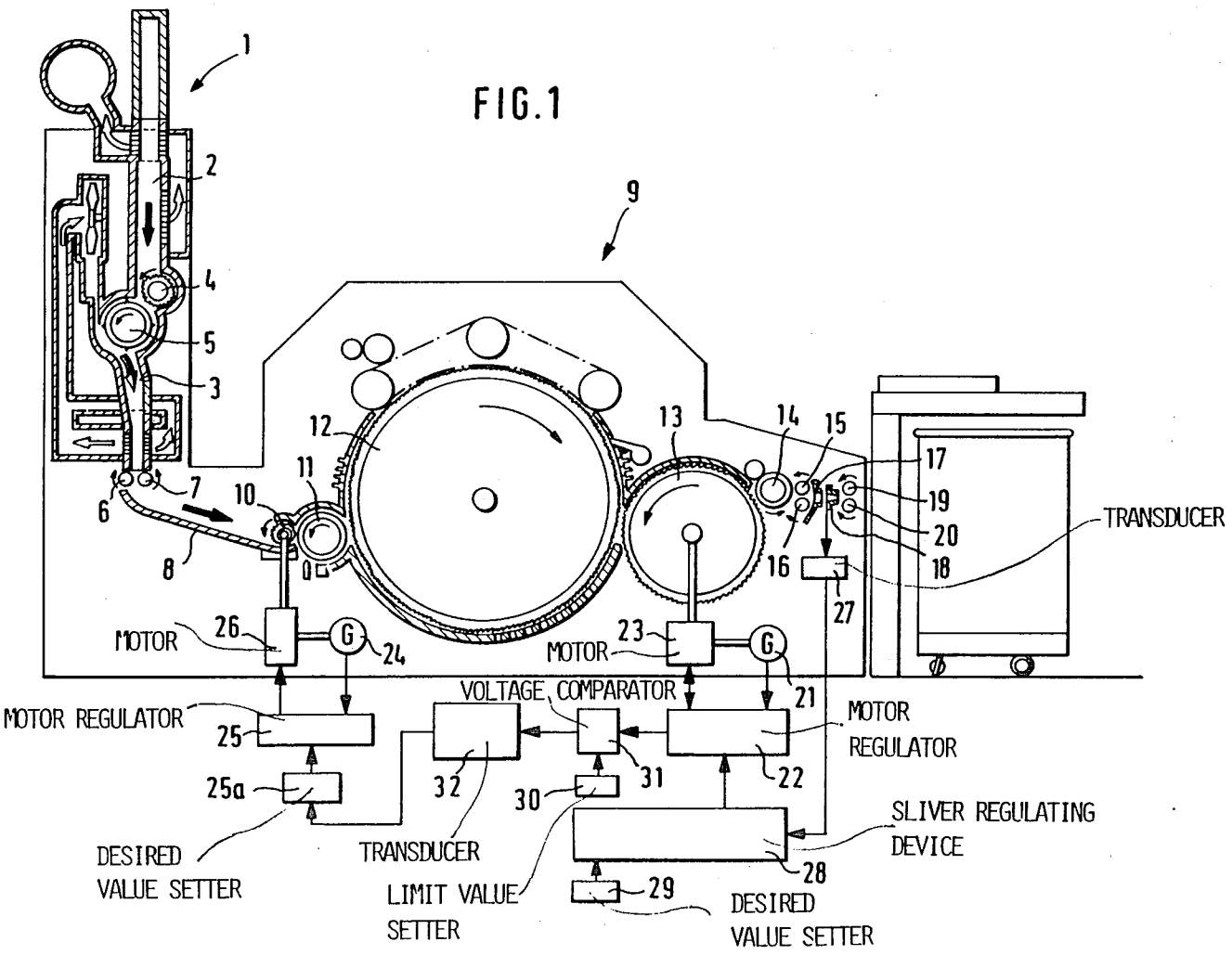
FIG. 1 is a schematic sectional side elevational view, with block diagram, of a preferred embodiment of the invention wherein the card feed roller is regulated.

Turning to FIG. 1, there is shown a known tuft feeder 1 which may be an "EXACTAFEED FBK" model, manufactured by Trützschler GmbH & Co. KG, Mönchengladbach, Federal Republic of Germany, supplying a fiber lap to a known card which may be a Trützschler "EXACTACARD DK 3" model. The tuft feeder 1 has an upper reserve chute 2 and a lower feed chute 3. A feed roller 4 and an opening roller 5 advance fiber tufts from the reserve chute 2 into the feed chute 3. At the lower or discharge end of the feed chute 3 there are provided cooperating discharge rolers 6 and 7 which draw the compacted fiber tufts out of the feed chute 3 and advance the same as a fiber lap on a feed tray 8. From the feed tray 8 the fiber lap is introduced into the card 9 which has a feed roller 10, a licker-in 11, a main carding cylinder 12, a doffer 13, a stripper roller 14, crushing rollers 15 and 16, a web guiding element 17, a sliver trumpet 18 and calender rollers 19, 20.

With the doffer 13 there is associated a motor regulator which comprises an electronic tachogenerator 21, an electronic motor regulator 22 (which may be a Siemens "SIMOREG" model) and an rpm-variable motor 23 which drives the doffer 13. The electronic motor regulator 23 comprises an rpm regulator with subordinated current regulator. The load portion is a semi-controlled one-phase bridge. A desired value setter for the output rate (corresponding, for example, to the rpm of the doffer 13) which may be, for example, a potentiometer, is connected with the electronic motor regulator 22 by means of a desired value preselector. The first motor regulating assembly associated with the doffer 13 is connected by means of an electric shaft with a second motor regulator serving the feed roller 10. The second motor regulating assembly comprises an electronic tachogenerator 24 associated with the feed roller 10, an electronic motor regulator 25 (which may be a Siemens "SIMOREG" model) and an rpm-variable motor 26 driving the feed roller 10. A desired value setter 25*a* for the feed roller 10, for example, a potentiometer, is connected with the electronic motor regulator 25.

There are further provided elements for regulating the uniformity of the sliver gathered by the sliver trumpet 18. A measuring element, for example, a mechanical sensor integrated in the sliver trumpet 18 detects fluctuations in the sliver thickness and the resulting excursions of the sensor element (not shown) of the trumpet 18 are converted into electric pulses by a transducer 27 which is connected with a sliver regulating device 28. In this manner, the desired rpm value for the feed roller 10 is continuously varied as a function of the fluctuations in the thickness (density) of the sliver. By virtue of corresponding alterations of the rpm of the feed roller 10, the quantity of the fiber material is varied, whereby a change in the weight (sliver number) of the sliver is obtained.

The regulating device 28 with a desired value setter 29 is connected with the motor regulator 22 and, by means of a limit value setter 30, with a limit value indicator, such as a voltage comparator 31. The latter is arranged between the motor regulator 22 and a transducer 32 which in turn is connected after the motor regulator 25.

Figure 2:
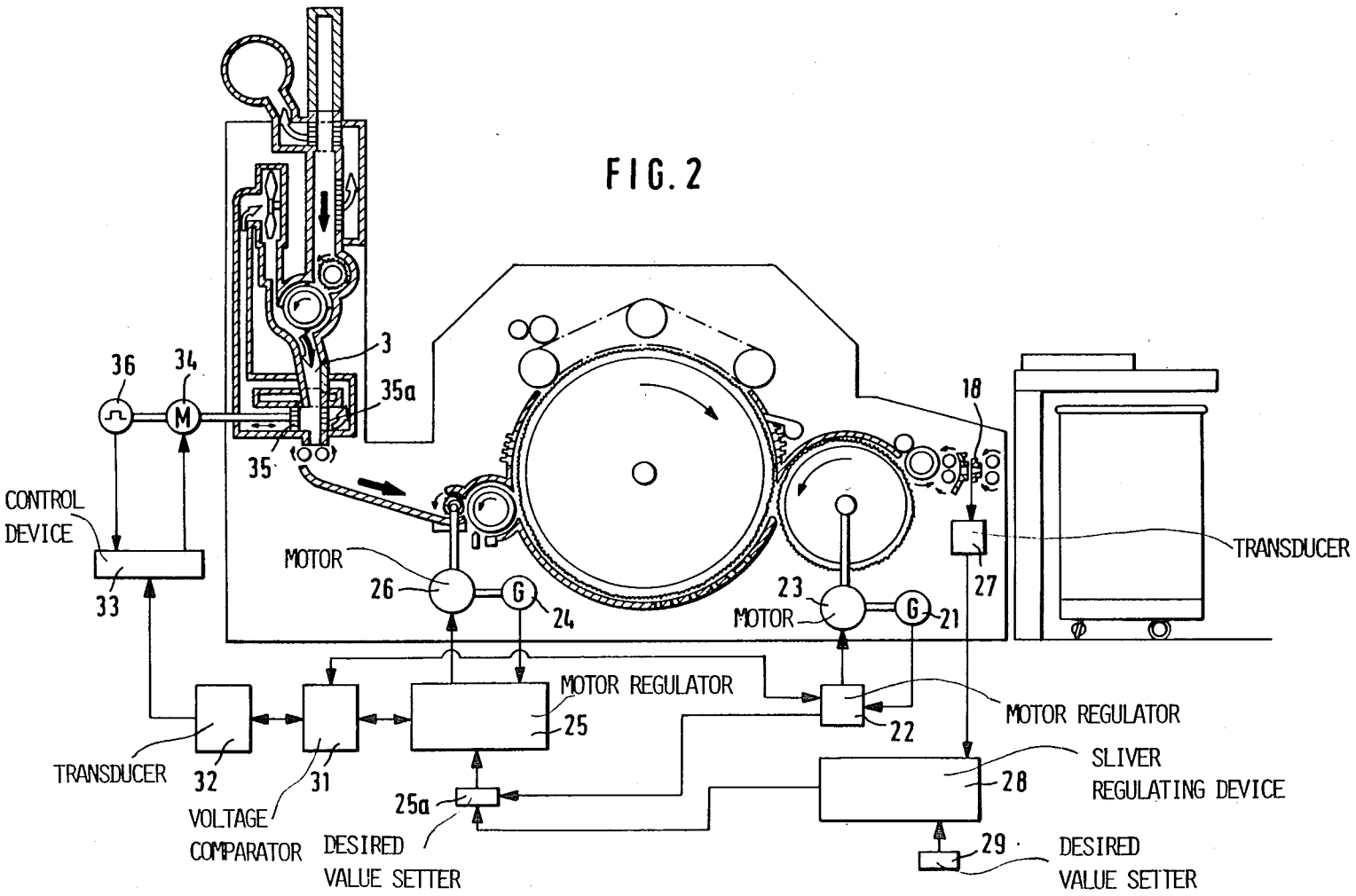
FIG. 2 is a schematic sectional side elevational view, with block diagram, of a second preferred embodiment of the invention, wherein the position of the feed chute wall of a tuft feeder is regulated.

Turning to FIG. 2, a limit value indicator, such as a voltage comparator 31 is connected with the motor regulators 22 and 25. The voltage comparator 31, with the intermediary of a transducer 32, applies its signals to a control device 33 which is connected with a drive motor 34 for shifting a wall element 35 of the feed chute 3 of the tuft feeder 1. By virtue of a horizontal displacement of the wall element 35 (provided with air outlet openings 35*a*) the depth of the feed chute 3 and thus the throughput of the fiber tuft quantities is varied. A position indicating device 36 is connected with the drive motor 34 and the control device 33.

Figure 3:
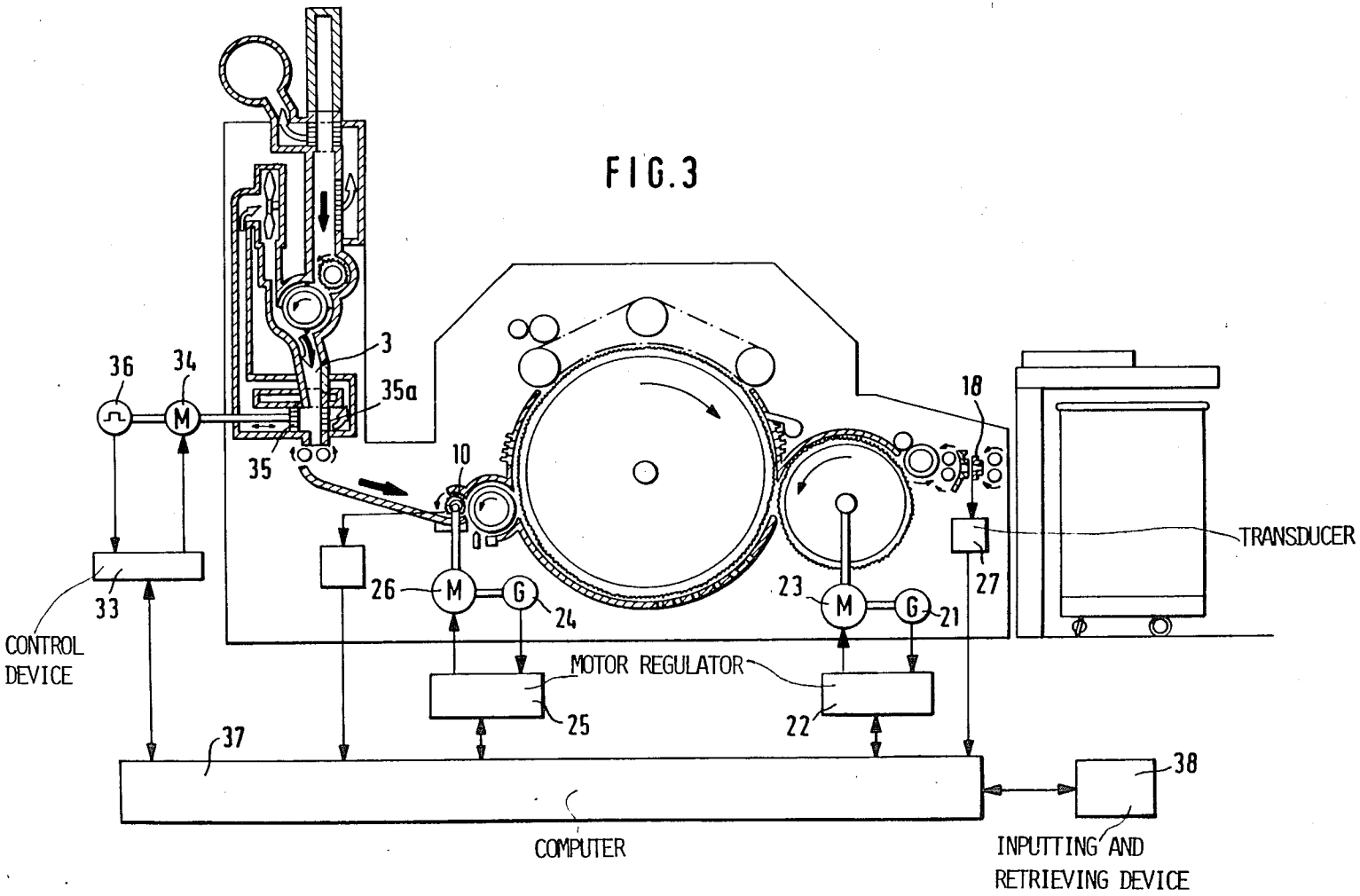
FIG. 3 is a schematic sectional side elevational view, with block diagram, of a third preferred embodiment of the invention in which both the feed roller and the feeder walls are regulated.

In the embodiment according to FIG. 3, the measuring member for the sliver mass, for example, the sliver trumpet 18 equipped with a mechanical sensor, the motor regulator 25 for regulating the rpm of the feed roller 10 and the control device 33 for shifting the wall element 35 are connected with a computer 37 (microcomputer) which may be a Trützschler "TMS" model, incorporating a Rockwell 6502 microprocessor. With the computer 37 there is associated an inputting and retrieving device 38. The computer 37 stores the predetermined setting values for the regulating device 25, compares them with actual values (such as voltage values) and upon excess, generates a signal which is applied to the control device 33 of the tuft feeder 1. The limit value indicating device is integrated in the computer 37.

The present disclosure relates to subject matter contained in Federal Republic of Germany patent application No. P 36 17 525.0 (filed May 24th, 1986) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In an apparatus in combination with a carding machine and a regulatable tuft feeding device for evening a running sliver produced by the carding machine; including a fiber-handling roller forming part of the carding machine, a motor drivingly connected to said roller, an rpm-setting device connected to said motor, a desired value setter connected with said regulatable tuft feeding device; measuring means for determining momentary values of mass of the running sliver; a regulator connected to the measuring means and to said rpm-setting device for controlling the rpm of said roller as a function of the sliver mass sensed by said measuring means; the improvement comprising a limit value indicating means connected to said rpm-setting device for responding to predetermined setting limits.

2. An apparatus as defined in claim 1, wherein said limit value indicating device is connected with said desired value setter.

3. An apparatus as defined in claim 1, wherein said limit value indicating device comprises a voltage comparator.

4. An apparatus as defined in claim 1, wherein said regulatable tuft feeding device comprises a tuft feeding apparatus operatively connected to an input of said carding machine.

5. An apparatus as defined in claim 4, wherein said tuft feeding apparatus comprises a tuft chute having a horizontally measured depth and including a wall adjustable for varying said depth; a drive motor connected to the wall for moving said wall and a control device connected to the wall-moving motor.

6. An apparatus as defined in claim 5, wherein said measuring means for determining momentary values of mass, said rpm-setting device and said control device connected to said wall-moving motor are coupled to a computer means for storing predetermined rpm values for the rpm-setting device for comparing measured actual values with the predetermined rpm values, for generating a setting signal in case a deviation between the predetermined rpm values and the measured actual values exceeds a predetermined limit, and for applying the setting signal to said control device connected to the wall-moving motor.

7. An apparatus as defined in claim 5, wherein said carding machine includes a feed roller constituting said fiber-handling roller and further wherein said regulatable tuft feeding device is formed by said feed roller;

said carding machine including a doffer, a motor drivingly connected to the doffer, an rpm-setting device connected to the doffer motor; further wherein said measuring means for determining momentary values of mass, said rpm-setting device connected to the doffer motor, said rpm-setting device connected to the feed roller and said control device connected to the wall-moving motor are coupled to a computer means for storing predetermined rpm values for the rpm-setting devices and said control device connected to the wall-moving motor, for comparing measured actual values with the predetermined rpm values, for generating a setting signal in case a deviation between the predetermined rpm values and the measured actual values exceeds a predetermined limit, and for applying the setting signal to said rpm-setting device connected with the feed roller motor and said control device connected to the wall-moving motor.

8. An apparatus as defined in claim 7, wherein said carding machine includes a doffer, a motor drivingly connected to the doffer, an rpm-setting device connected to the doffer motor; further wherein said measuring means for determining momentary values of mass, said rpm-setting device connected to the doffer motor and said rpm-setting device connected to the feed roller are coupled to a computer means for storing predetermined rpm values for the rpm-setting devices, for comparing measured actual values with the predetermined rpm values, for generating a setting signal in case a deviation between the predetermined rpm values and the measured actual values exceeds a predetermined limit, and for applying the setting signal to said rpm-setting device connected with the feed roller motor.

9. An apparatus as defined in claim 1, wherein said carding machine includes a feed roller constituting said fiber-handling roller and further wherein said regulatable tuft feeding device is formed by said feed roller.

* * * * *